US008267245B2

(12) United States Patent
Kotula et al.

(10) Patent No.: US 8,267,245 B2
(45) Date of Patent: Sep. 18, 2012

(54) METHOD AND PACKAGE FOR DISPLAYING MAGNETIC TOOL CONTAINER

(75) Inventors: Stanley K. Kotula, Baltimore, MD (US); Darren B. Moss, York, PA (US); Daniel G. Findle, White Hall, MD (US); Mark E. Brunson, Bel Air, MD (US); David B. Lee, Baltimore, MD (US); Lauren M. Wenchel, Sparks, MD (US)

(73) Assignee: Black & Decker Inc., Newark, DE (US)

( * ) Notice: Subject to any disclaimer, the term of this patent is extended or adjusted under 35 U.S.C. 154(b) by 236 days.

(21) Appl. No.: 12/723,133

(22) Filed: Mar. 12, 2010

(65) Prior Publication Data

US 2011/0048988 A1 Mar. 3, 2011

Related U.S. Application Data

(63) Continuation-in-part of application No. 29/342,878, filed on Sep. 2, 2009, now Pat. No. Des. 624,317.

(51) Int. Cl.
*B65D 85/28* (2006.01)

(52) U.S. Cl. ..... 206/350; 206/818; 206/372; 220/23.87

(58) Field of Classification Search ..... 206/372, 206/373, 234, 818, 379, 461, 462, 463, 470, 206/471, 350, 736; 220/23.87, 810, 553, 220/751

See application file for complete search history.

(56) References Cited

U.S. PATENT DOCUMENTS

| | | | | |
|---|---|---|---|---|
| 2,702,649 | A | 2/1955 | Neilson | |
| 2,730,263 | A | 1/1956 | Neilson | |
| 3,656,727 | A | 4/1972 | Greenlee | |
| 3,983,976 | A | 10/1976 | Taylor | |
| 4,131,203 | A | 12/1978 | Bridges | |
| 4,133,507 | A | 1/1979 | Chervenak | |
| 4,160,570 | A | 7/1979 | Bridges | |
| 4,611,716 | A | 9/1986 | Sorlien | |
| 4,619,364 | A * | 10/1986 | Czopor, Jr. | 206/379 |
| 4,703,850 | A | 11/1987 | Walker | |
| 4,899,971 | A | 2/1990 | Elkin | |
| RE33,191 | E * | 4/1990 | Matney | 206/470 |
| 4,930,628 | A | 6/1990 | Bridges | |
| 5,133,455 | A | 7/1992 | Chow | |
| 5,924,615 | A | 7/1999 | McGarrah | |
| 6,152,299 | A * | 11/2000 | O'Malley et al. | 206/471 |
| 6,161,693 | A * | 12/2000 | Findle et al. | 206/470 |
| 6,237,767 | B1 | 5/2001 | Lee | |
| 6,322,177 | B1 | 11/2001 | Vasudeva | |
| 6,401,996 | B1 | 6/2002 | Thom et al. | |
| 6,467,577 | B1 | 10/2002 | Charlebois, Jr. | |
| 6,554,131 | B1 * | 4/2003 | Findle et al. | 206/372 |

(Continued)

*Primary Examiner* — Andrew Perreault

(74) *Attorney, Agent, or Firm* — Scott B. Markow

(57) ABSTRACT

A display package includes a blister assembly and a storage container. The blister assembly includes a front blister surface having a first opening therein and a rear blister surface coupled to the front blister surface and defining a first cavity. The storage container includes a first container portion secured within the first cavity, a second container portion hingedly coupled to the first container portion for pivotal displacement between an open position and a closed position, and a magnet fixed to an outer surface of the second container portion. The magnet is located at or beyond an outer perimeter of the blister assembly when the first container portion is secured within the first cavity. The magnet is configured to secure the display package to a metallic structure.

14 Claims, 10 Drawing Sheets

U.S. PATENT DOCUMENTS

| | | | |
|---|---|---|---|
| 6,868,967 | B2 | 3/2005 | Lam |
| 6,905,015 | B2 | 6/2005 | Hernandez, Jr. et al. |
| 6,991,105 | B2 | 1/2006 | Winnard |
| 7,228,983 | B2 | 6/2007 | Pangerc et al. |
| 7,258,230 | B2 | 8/2007 | Hernandez, Jr. et al. |
| 7,559,427 | B2 | 7/2009 | Hu |
| 2002/0179437 | A1 | 12/2002 | Ko |
| 2004/0084342 | A1 | 5/2004 | Chang |
| 2005/0199522 | A1 | 9/2005 | Hu |
| 2005/0218023 | A1 | 10/2005 | Winnard |
| 2005/0221664 | A1 | 10/2005 | Winnard |
| 2005/0247585 | A1 | 11/2005 | Breckwoldt et al. |
| 2006/0234846 | A1 | 10/2006 | Tucker |
| 2006/0250057 | A1 | 11/2006 | Vasudeva |
| 2008/0041746 | A1 | 2/2008 | Hsiao |
| 2008/0105574 | A1 | 5/2008 | Grundler |
| 2008/0149678 | A1 | 6/2008 | Huang |
| 2008/0314795 | A1 | 12/2008 | Lin |

* cited by examiner

METHOD AND PACKAGE FOR DISPLAYING MAGNETIC TOOL CONTAINER

CROSS-REFERENCE TO RELATED APPLICATIONS

This application is a continuation-in-part of U.S. patent application Ser. No. 29/342,878 filed on Sep. 2, 2009. The entire disclosure of the above application is incorporated herein by reference.

FIELD

The present disclosure relates to magnetic tool containers and corresponding display packaging.

BACKGROUND

This section provides background information related to the present disclosure which is not necessarily prior art.

Accessory containers are commonly used throughout the construction industry. Various containers are generally used to organize small parts such as driver and drill bits, nails, fasteners, etc. Some work sites may not have a convenient location to secure the accessory containers. Additionally, dedicated racks or locations at retailers selling the storage containers are often required for display of the containers.

SUMMARY

This section provides a general summary of the disclosure, and is not a comprehensive disclosure of its full scope or all of its features.

A storage container includes a container base, a container cover, and a magnet. The container cover is hingedly coupled to the container base for pivotal displacement between an open position and a closed position. The container cover and base are disposed at a maximum angle of between sixty and one-hundred and twenty degrees relative to one another when in the open position. The magnet is fixed to the container cover and configured to secure the storage container to a metallic structure.

In another arrangement, a storage container includes a container base, a container cover, and a magnet. The container base defines a first hinged region on a first side thereof. The container cover defines a second hinged region coupled to the container base for pivotal displacement between an open position and a closed position. The magnet is fixed to a second side of the container base opposite the first side and configured to secure the storage container to a metallic structure.

A display package includes a blister assembly and a storage container. The blister assembly includes a front blister surface having a first opening therein and a rear blister surface coupled to the front blister surface and defining a first cavity. The storage container includes a first container portion secured within the first cavity, a second container portion hingedly coupled to the first container portion for pivotal displacement between an open position and a closed position, and a magnet fixed to an outer surface of the second container portion. The magnet is located at or beyond an outer perimeter of the blister assembly when the first container portion is secured within the first cavity. The magnet is configured to secure the display package to a metallic structure.

In another arrangement, a display package includes a blister assembly and a storage container. The blister assembly includes a front blister surface having a first opening therein and a rear blister surface coupled to the front blister surface and defining a first cavity. The storage container includes a container base secured within the first cavity, a container cover hingedly coupled to the container base for pivotal displacement between an open position and a closed position when the storage container is secured within the blister assembly, and a magnet fixed to an outer surface of the container cover. The magnet is located at or beyond an outer perimeter of the blister assembly when the container base is secured within the first cavity and the container cover is in the open position. The magnet is configured to secure the display package to a metallic structure.

A display method includes providing a display package including a storage container secured to a blister assembly and attaching the display package to a metallic structure. The storage container includes a first container portion, a second container portion, and a magnet. The second container portion is hingedly coupled to the first container portion and is displaceable between open and closed positions while the storage container is secured to the blister assembly. The magnet is fixed to an outer surface of the container cover and is located at or beyond an outer perimeter of the blister assembly. The display package is attached to the metallic structure via the magnet.

In another arrangement, a method includes providing a display package including a storage container secured to a blister assembly. The storage container includes a container base, a container cover hingedly coupled to the container base and displaceable between open and closed positions while the storage container is secured to the blister assembly, and a magnet fixed to an outer surface of the container cover. The magnet is located at or beyond an outer perimeter of the blister assembly when the container cover is in the open position. The method further includes locating the container cover in the open position and attaching the display package to a metallic structure via the magnet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
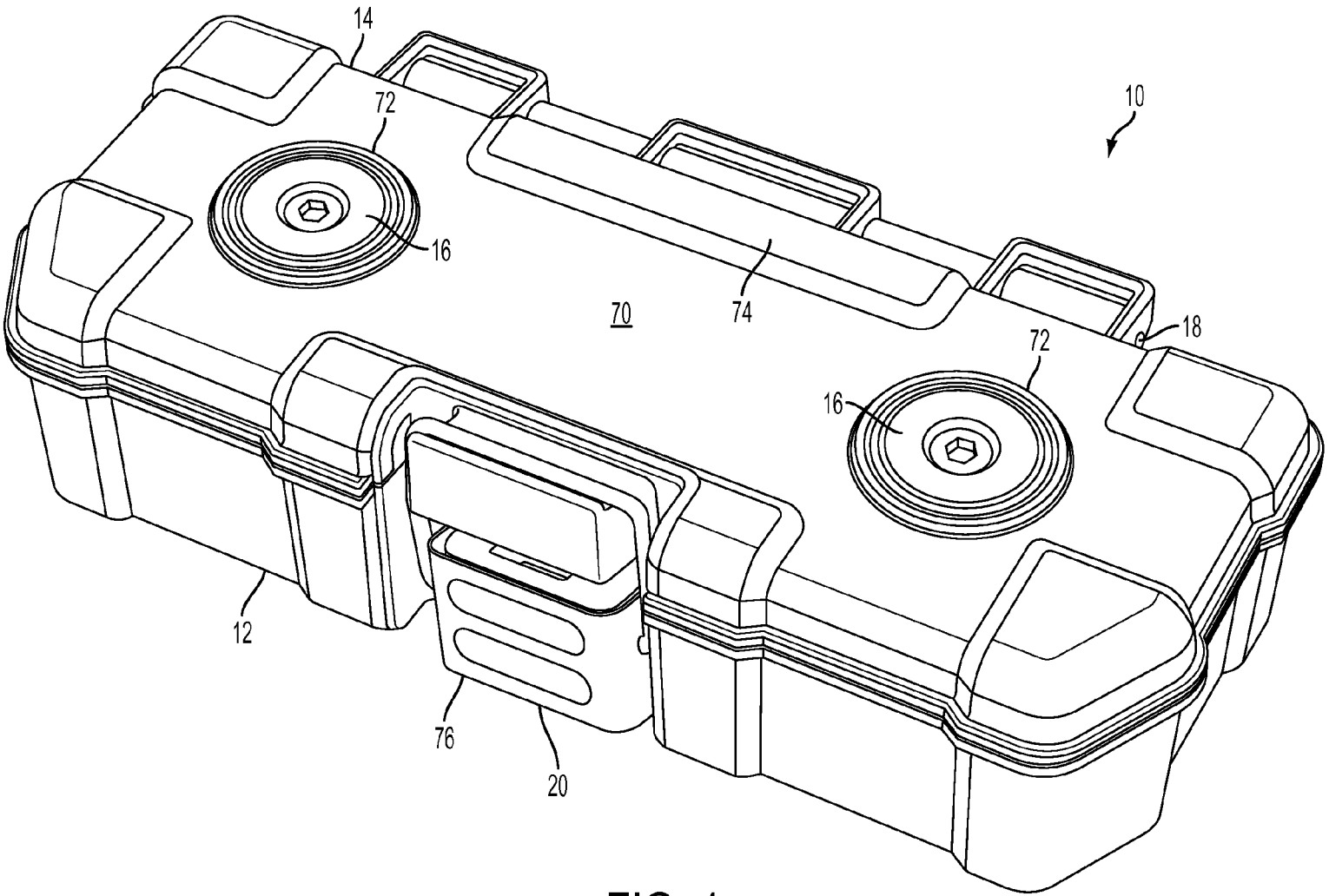
FIG. 1 is a front perspective view of a storage container according to the present disclosure.
Figure 2:
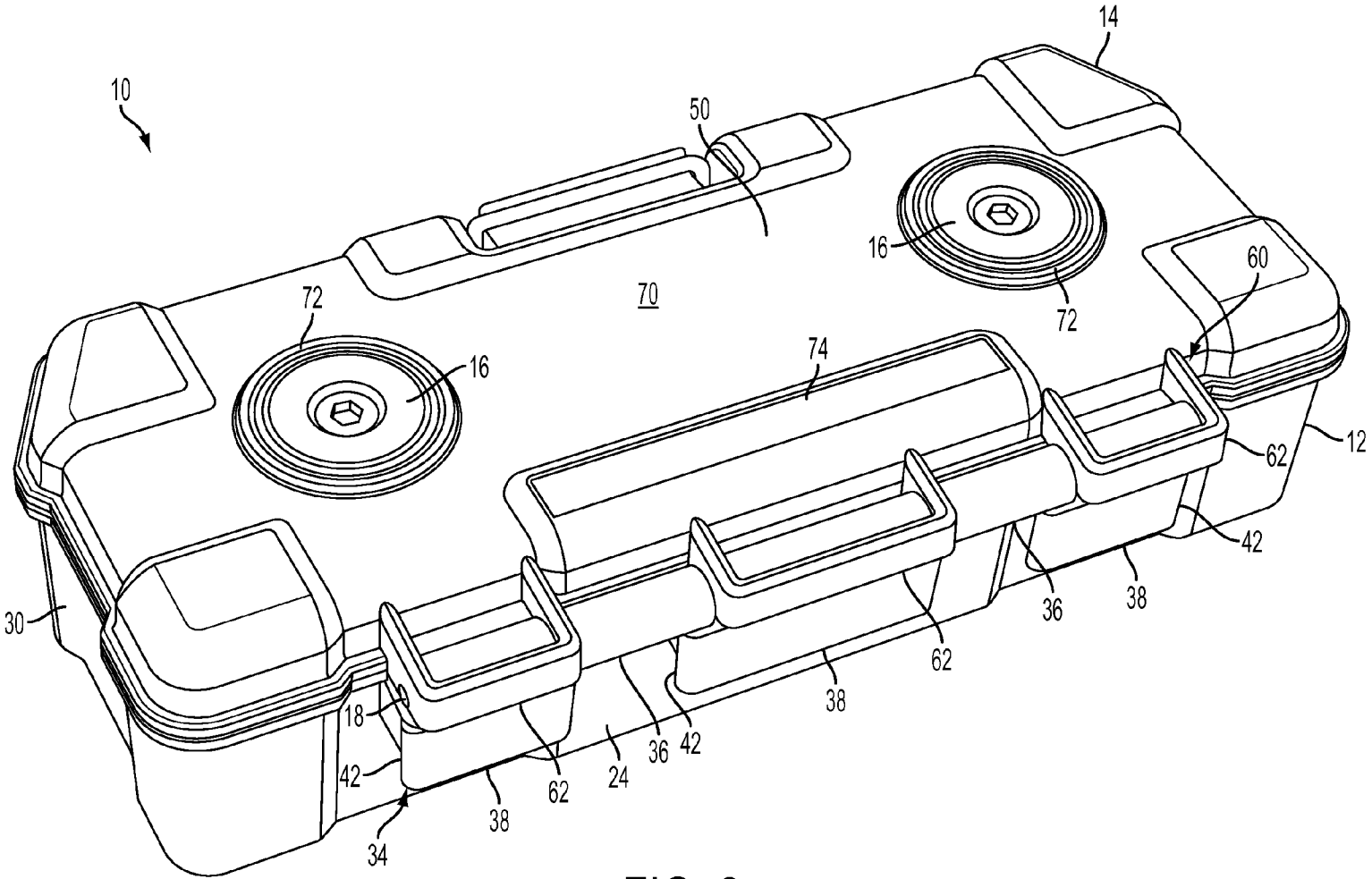
FIG. 2 is a rear perspective view of the storage container of FIG. 1.
Figure 3:
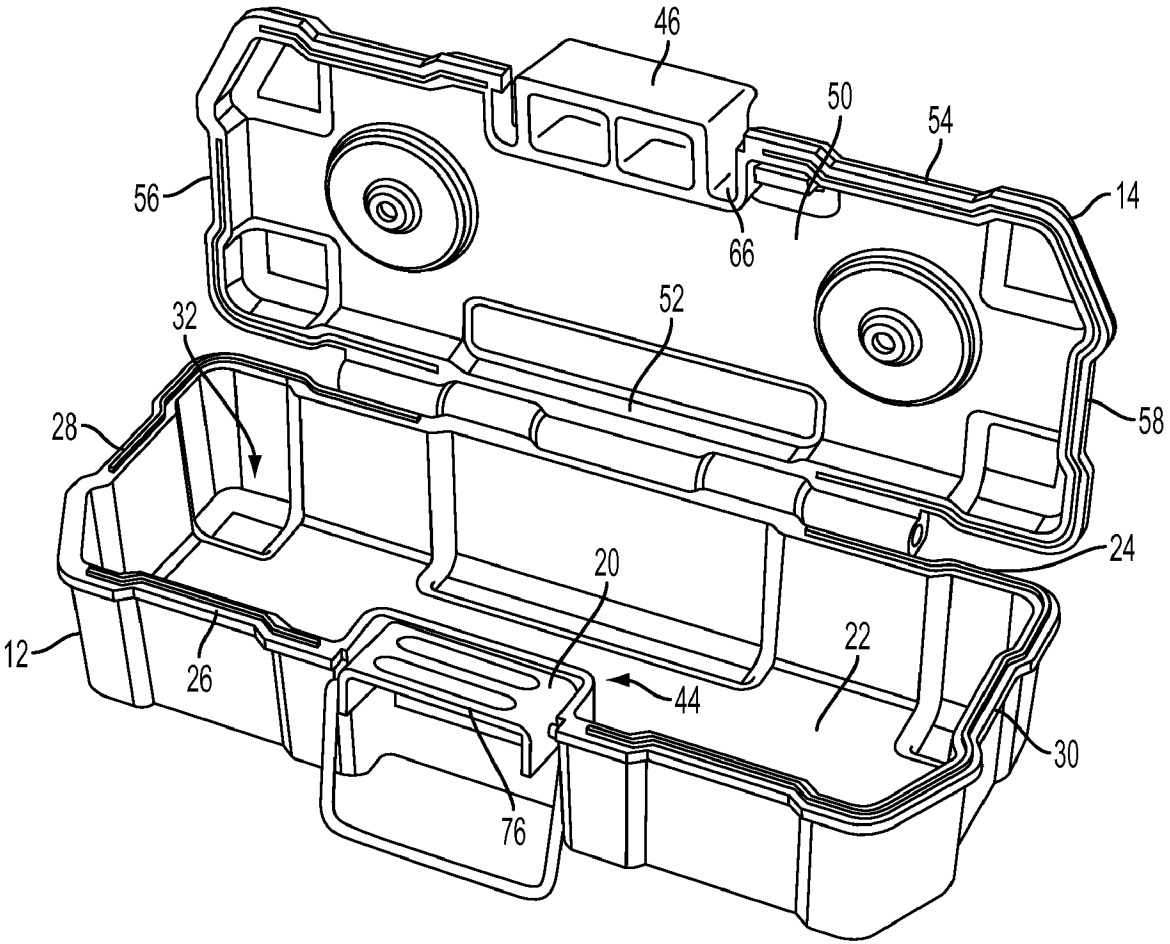
FIG. 3 is a front perspective view of the storage container of FIG. 1 shown in an open position.
Figure 4:
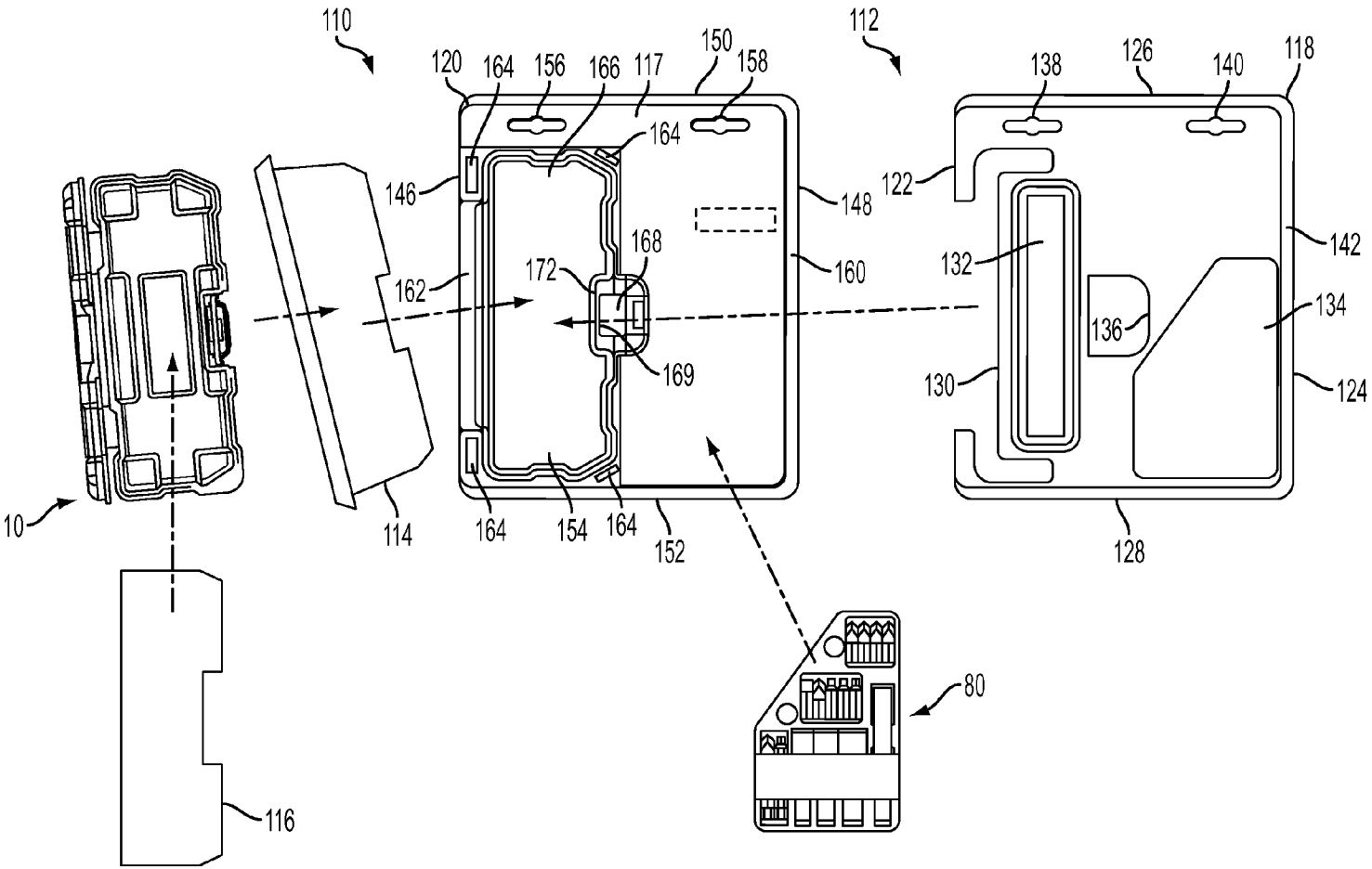
FIG. 4 is an exploded view of a display package for the storage container according the present disclosure.
Figure 5:
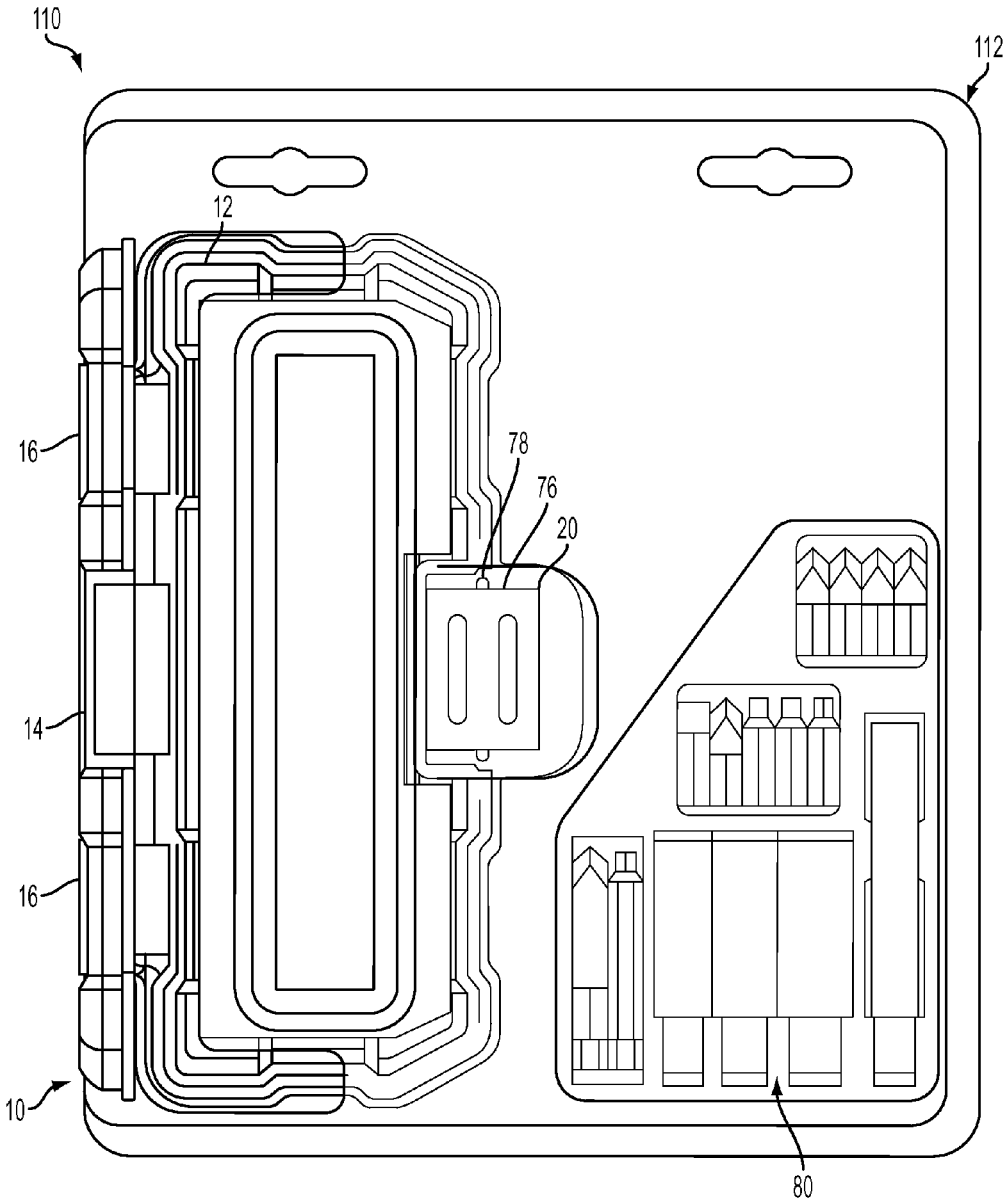
FIG. 5 is a top plan view of the display package shown in FIG. 4 in an assembled condition for receiving and displaying the storage container of FIG. 1 with the cover in the open position.
Figure 6:
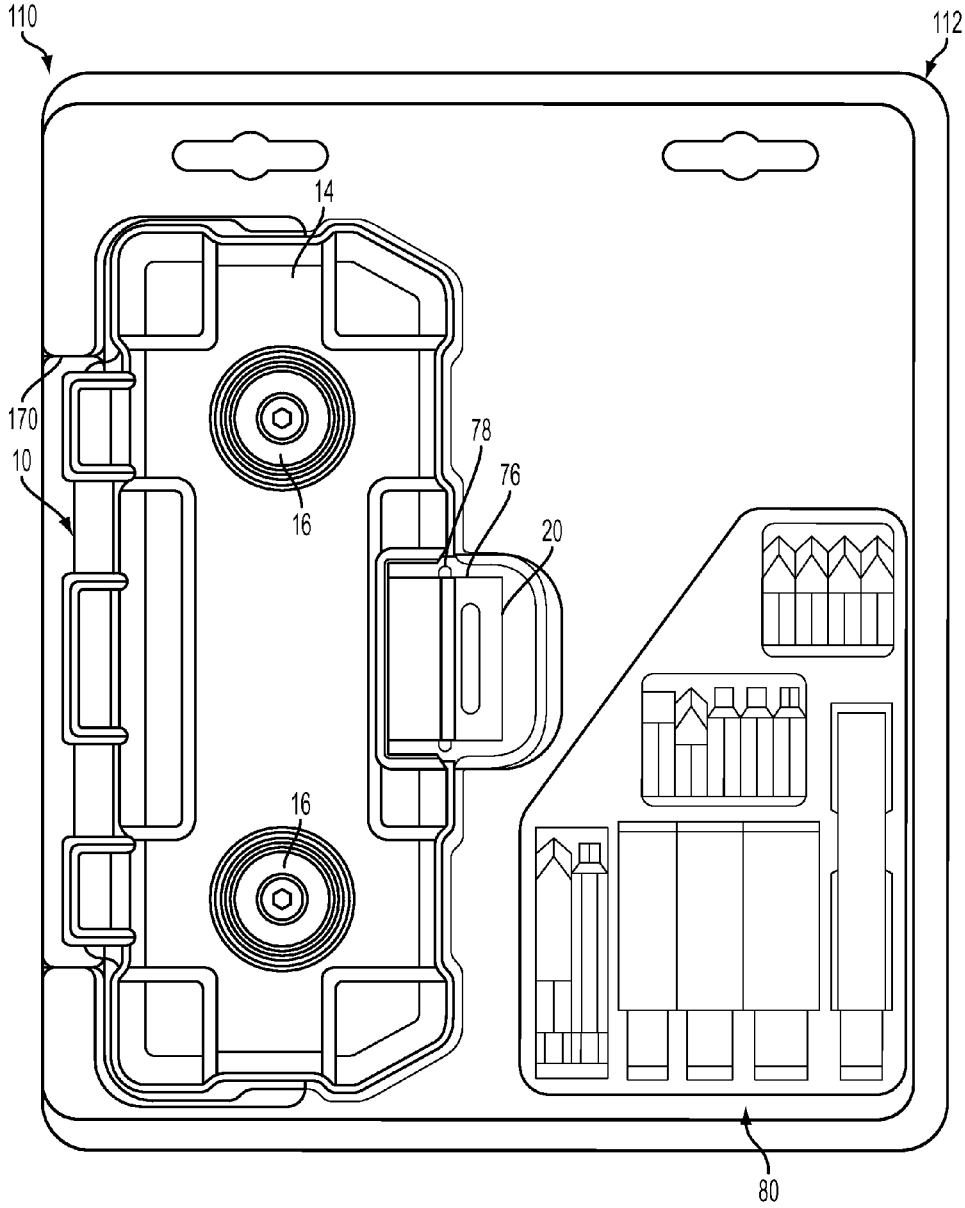
FIG. 6 is a top plan view of the display package shown in FIG. 4 in an assembled condition for receiving and displaying the storage container of FIG. 1 with the cover in the closed position.

With reference to FIGS. 1-3, a storage container 10 is illustrated. The storage container 10 includes first and second container portions 12, 14, magnets 16 disposed in the second container portion 14, a hinge pin 18 connecting the first and second container portions 12, 14 and a latch mechanism 20 for securing the first and second container portions 12, 14 in a closed position. In the example illustrated in FIGS. 1-3, the first container portion 12 forms a container base and the second container portion 14 forms a container cover.

The first container portion 12 includes a base portion 22 (FIG. 3) and sidewalls 24, 26, 28, 30 extending from the base portion 22 to define a tool container 32. First and second sidewalls 24, 26 are generally opposite one another. A first hinge region 34 (FIG. 2) is located on the first sidewall 24 and includes first and second sets of protrusions 36, 38. The first protrusions 36 define first hinge pin bores (not shown) and are interposed between adjacent ones of the second protrusions 38. The second protrusions 38 may be located between the first protrusions 36 and the base portion 22 along the height of the first container portion 12. The second protrusions 38 may define hooks 42 (best shown in FIG. 3) facing the base portion 22 to facilitate mounting the storage container 10 on a rail (not shown). A first latch region 44 is located on the second sidewall 26 and includes a protrusion 46 having the latch mechanism 20 mounted thereon.

The second container portion 14 includes a lid portion 50 and sidewalls 52, 54, 56, 58 extending from the lid portion 50. First and second sidewalls 52, 54 are generally opposite one another. A second hinge region 60 is located on the first sidewall 52 and includes a first set of protrusions 62, best shown in FIG. 2. The first protrusions 62 define second hinge pin bores (not shown). A second latch region 66 is located on the second sidewall 54 and is selectively engaged with the latch mechanism 20 to secure the first and second container portions 12, 14 to one another. The first container portion 12 defines a depth that is greater than a depth defined by the second container portion 14.

Magnets 16 are located on an outer surface 70 of the lid portion 50 for securing the storage container 10 to a metallic structure. The outer surface 70 may additionally include elastomeric members 72 surrounding each of the magnets 16. Additional elastomeric members 74 may also be located on other regions of the outer surface 70 of the lid portion 50. The elastomeric members 72, 74 may extend slightly beyond the outer surface of the magnets 16 to provide friction at the mounting interface of the storage container 10 and metallic structure.

The hinge pin 18 is located within the first and second hinge bores of the first and second container portions 12, 14 and hingedly couples the first and second container portions 12, 14 to one another. The second container portion 14 may be pivotally displaced about the hinge pin 18 from a closed position (FIGS. 1 and 2) to an open position (FIG. 3). Opening of the second container portion 14 may be limited by engagement between the first and second hinge regions 34, 60. The second container portion 14 may be limited to between sixty and one-hundred and twenty degrees of travel about the hinge pin 18. In the present non-limiting example, the second container portion 14 is limited to approximately ninety degrees of travel about the hinge pin 18. Therefore, the second container portion 14 is generally perpendicular to the first container portion 12 when in the open position.

The latch mechanism 20 is displaceable between a locked position (FIGS. 1 and 2) and an unlocked position (FIG. 3). The latch mechanism 20 secures the first and second container portions 12, 14 to one another when the second container portion 14 is in the closed position and the latch mechanism 20 is in the locked position. The latch mechanism 20 includes a latch arm 76 pivotally secured to the first container portion 12 at the first latch region 44 and a hook member 78 pivotally coupled to the latch arm 76. The hook member 78 engages the second latch region 66 of the second container portion 14 when in the locked position to secure the first and second container portions 12, 14 in the closed position.

As seen in FIGS. 4-8, a display package 110 for displaying the storage container 10 is illustrated. The display package 110 includes the storage container 10 and a blister assembly 112. The display package 110 may additionally include a tool set 80 and cardboard or paper display insert cards 114, 116, 117 having product information and/or images printed thereon. The tool set 80 can include a tray that receives a plurality of tool bits. The blister assembly 112 includes a two-piece or clam shell thermoplastic blister formed from front and rear blister surfaces 118, 120. The front and rear blister surfaces 118, 120 may each be formed from a rigid clear plastic. By way of non-limiting example, the front and rear blister surfaces 118, 120 may each be formed from clear Polyvinyl Chloride (PVC) or Polyethylene Terephthalate (PET) having a thickness of at least 0.3 millimeters (mm), and more specifically of approximately 0.45 mm.

The front blister surface 118 includes outer edges 122, 124, 126, 128 defining an outer perimeter thereof, a recess 130 extending into the first outer edge 122, first and second cavities 132, 134, an aperture (die cut hole) 136 and cutouts 138, 140. A first ribbed channel 142 is defined at the outer perimeter of the front blister surface 118 for mating the front and rear blister surfaces 118, 120, as discussed below. The first cavity 132 extends into the front blister surface 118 toward the rear blister surface 120 and the second cavity 134 extends into the front blister surface 118 in a direction generally opposite the first cavity 132 and away from the rear blister surface 120.

The rear blister surface 120 includes outer edges 146, 148, 150, 152 defining an outer perimeter thereof, a cavity 154, and cutouts 156, 158. A second ribbed channel 160 is defined at the outer perimeter of the rear blister surface 120 for mating the front and rear blister surfaces 118, 120, as discussed below. The cavity 154 extends into the rear blister surface 120 and outward from the from blister surface 118. The first edge 146 includes a recessed portion 162 adjacent the cavity 154.

The storage container 10, tool set 80, and display insert cards 114, 116, 117 are captured between the front and rear blister surfaces 118, 120. More specifically, during assembly a first of the display insert cards 114 may be located within the cavity 154. The storage container 10 is then located in the cavity 154 while in the open position. A second of the insert cards 116 may be located in the storage container 10 on the base portion 22 of the first container portion 12 and the tool set 80 may be located on the rear blister surface 120. A third of the insert cards 117 may additionally be located on the rear blister surface 120. The front blister surface 118 is then located on and secured to the rear blister surface 120. Both sides of the third insert card 117 may be visible through the blister assembly 112.

The first and second ribbed channels 142, 160 interfit with one another to secure the front and rear blister surfaces 118, 120 to one another. The front and rear blister surfaces 118, 120 may be thermoformed together around the first and second ribbed channels 142, 160. The blister assembly 112 additionally includes seal regions 164 to further secure the front and rear blister surfaces 118, 120 to one another. The front and rear blister surfaces 118, 120 may additionally be thermoformed together at the seal regions 164.

When assembled, the first cavity 132 defined in the front blister surface 118 extends into the first container portion 12 and secures the first container portion 12 within a first portion 166 of the cavity 154 in the rear blister surface 120. The aperture 136 in the front blister surface 118 overlies a second portion 168 of the cavity 154. An additional aperture (die cut hole) 169 may be located in the second portion 168 of the cavity 154 to provide finger access to the latch mechanism 20. The second insert card 116 is secured within the first container portion 12 between the base portion 22 and the portion of the front blister surface 118 defining the first cavity 132. The tool set 80 is secured within the second cavity 134.

The first sidewalls 24, 52 of the first and second container portions 12, 14 are located adjacent the first outer edges 122, 146 of the front and rear blister surfaces 118, 120. More specifically, the first and second hinge regions 34, 60 are located at an opening 170 defined by the recess 130 in the front blister surface 118 and the recessed portion 162 at the first edge 146 of the rear blister surface 120. The second container portion 14 may be displaceable between the open and closed positions after the storage container 10 is secured within the blister assembly 112. When in the open position, the magnets 16 may be located at or beyond an outer edge of the blister assembly 112 defined at the first outer edges 122, 146 of the front and rear blister surfaces 118, 120.

The latch mechanism 20 is located within the second portion 168 of the cavity 154 in the rear blister surface 120 and is accessible through the aperture 136 in the first blister surface 118. The latch mechanism 20 may be secured in the unlocked position by the blister assembly 112. More specifically, the hook member 78 may be secured between the second sidewall 54 and a wall 172 defined at an interface between the first and second portions 166, 168 of the cavity 154 in the rear blister surface 120. The hook member 78 may therefore be prevented from displacement to the locked position. However, if the latch mechanism 20 is in the locked position it may be displaced to the unlocked position through the aperture 169.

Figure 7:
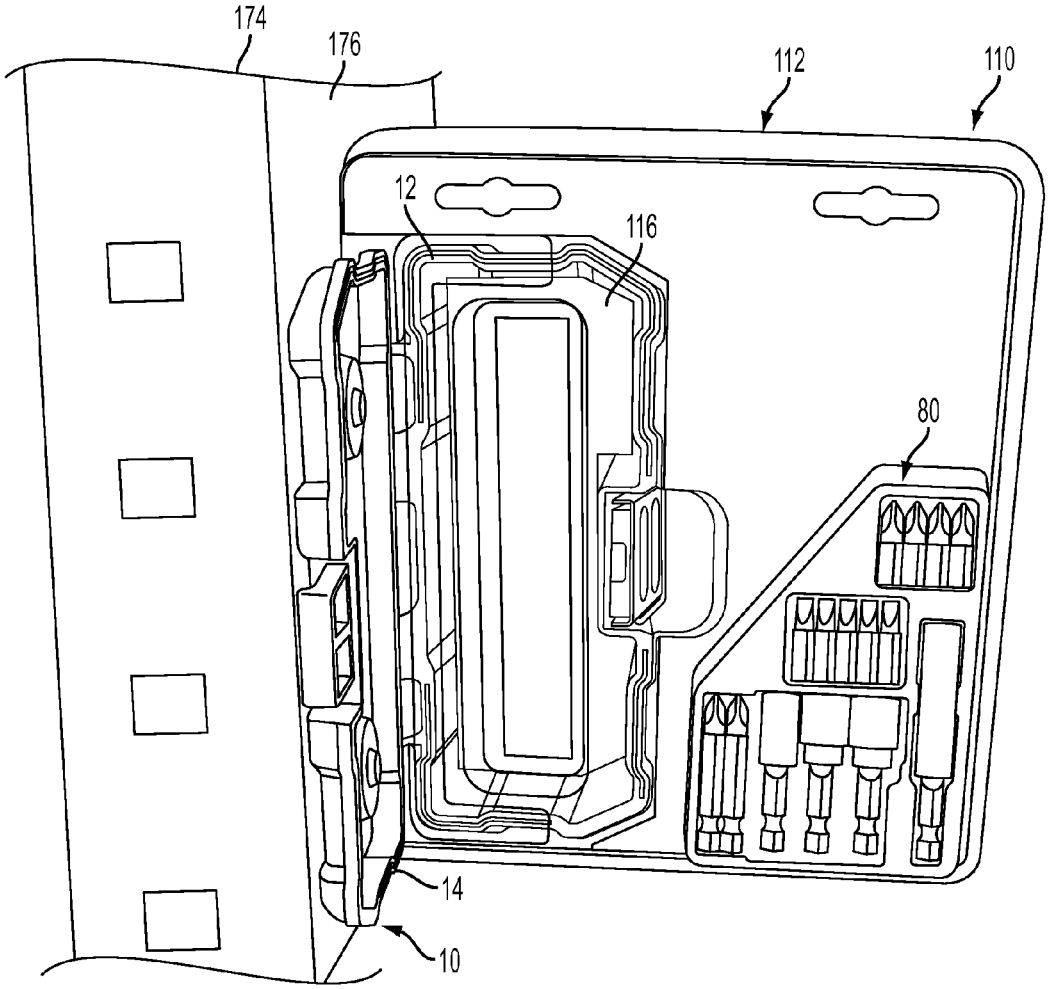
FIG. 7 is an illustration of the display package and storage container of FIGS. 4-6 mounted to a display structure using magnets disposed in the lid of the storage container.
Figure 8:
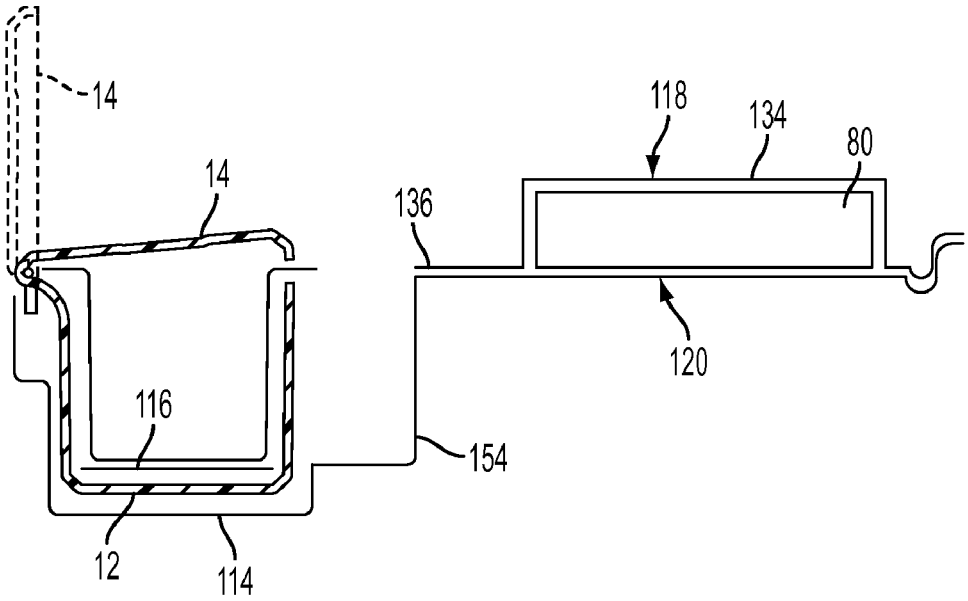
FIG. 8 is a side cross-sectional view of the storage container of FIG. 1.

As seen in FIG. 7, the display package 110 may be mounted to a display structure 174 by the magnets 16 on the storage container 10. The display structure 174 may generally include any metallic structure. In the non-limiting example shown in FIG. 7, the display structure 174 includes a metal beam defining a planar surface 176. The second container portion 14 of the storage container 10 may be displaced to the open position to mount the display package 110 on the display structure 174.

As discussed above, the second container portion 14 is generally perpendicular to the first container portion 12 when in the open position. Therefore, the second container portion 14 is also generally perpendicular to the front and rear blister surfaces 118, 120 when in the open positions. The arrangement of the storage container 10 within the blister assembly 112 provides for securing the display package 110 to the display structure 174 with magnets 16 engaged with the planar surface 176 and the first outer edges 122, 146 of the front and rear blister surfaces 118, 120 being directly adjacent to the planar surface 176.

The display package 110 generally provides for display of the storage container 10 without a dedicated rack or location within a retailer. The mounting of the display package 110 with the second container portion 14 in the open position additionally provides for display of the second insert card 116. The second insert card 116 may take a variety of forms including, but not limited to, a cardboard or paper insert with tool images and product information.

Figure 9:
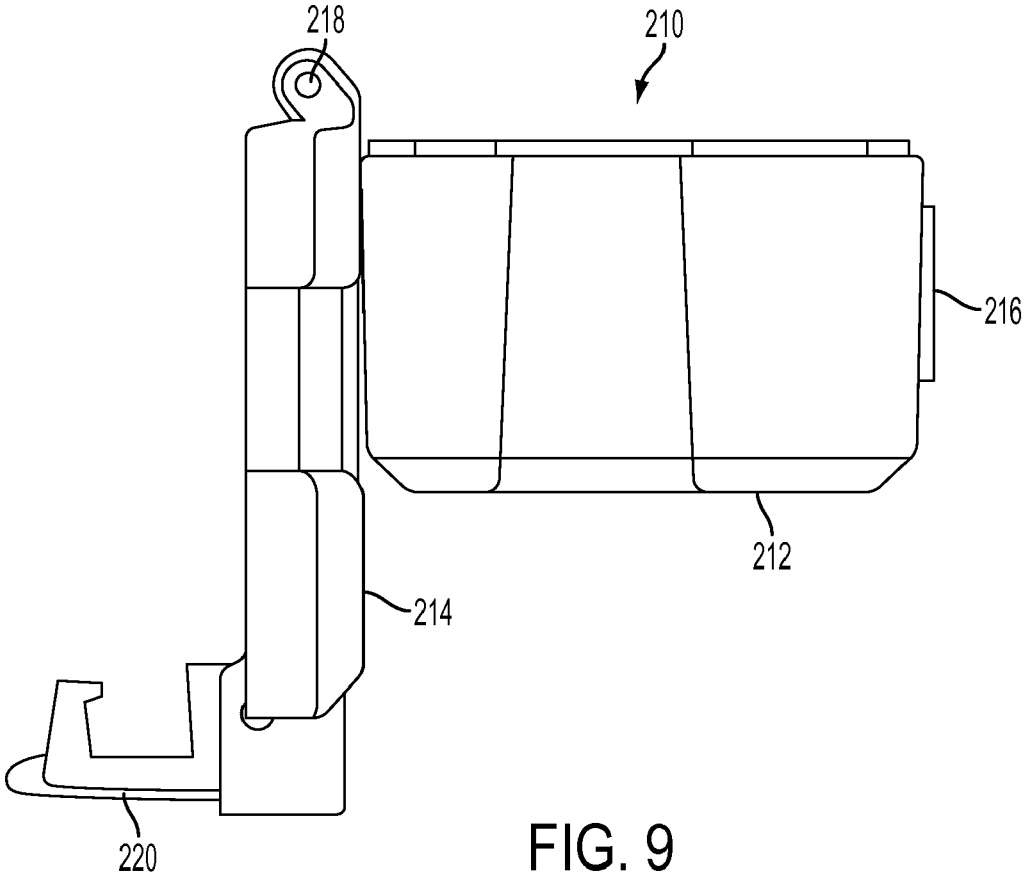
FIG. 9 is a plan view of an alternate storage container according to the present disclosure.

An alternate storage container 210 is illustrated in FIG. 9. The storage container 210 includes first and second container portions 212, 214, magnets 216, a hinge pin 218 and a latch mechanism 220. The first container portion 212 forms a container base and the second container portion 214 forms a container cover. The storage container 210 may be generally similar to the storage container 10. However, the magnets 216 are mounted to a sidewall of the first container portion 212 opposite the hinge pin 218 rather than being mounted to the second container portion 214. Additionally, the second container portion 214 of the storage container 210 has a greater pivot extent about the hinge pin 218. As seen in FIG. 9, the second container portion 214 may be displaced by approximately two-hundred and seventy degrees from the closed position (not shown) to the open position, as illustrated.

Figure 10:
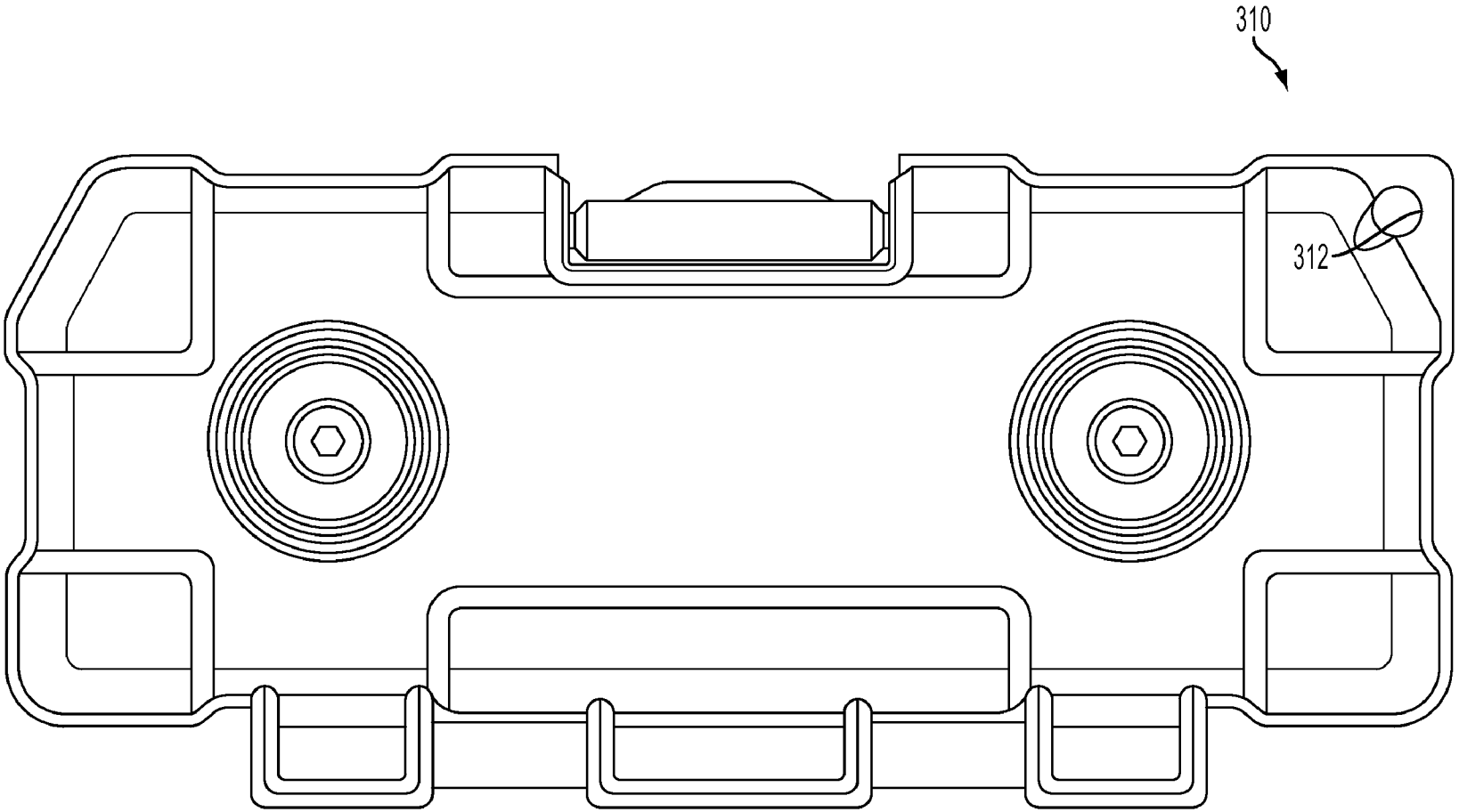
FIG. 10 is a plan view of a storage container including a mounting structure according to the present disclosure.

FIG. 10 illustrates a mounting structure 310. The mounting structure 310 includes an aperture 312 that can receive a hook, lanyard, or variety of other mechanisms for securing a storage container to a user. Either of the storage containers 10, 210 illustrated above may additionally include the mounting structure 310. The aperture 310 may extend through the first container portion 12, 212 (container base) and/or the second container portion 14, 214 (container cover).

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A display package comprising:

a blister assembly including a front blister surface having a first opening therein and a rear blister surface coupled to said front blister surface and defining a first cavity; and a storage container including a first container portion secured within said first cavity, a second container portion hingedly coupled to said first container portion for pivotal displacement between an open position and a closed position when said storage container is secured within said blister assembly, and a magnet fixed to an outer surface of said second container portion and extending laterally to or beyond an outer perimeter defined by a lateral edge of said front and rear blister surfaces of said blister assembly when said first container portion is secured within said first cavity and said second container portion is in the open position, said magnet configured to secure the display package to a metallic structure.

2. The display package of claim 1, wherein said first container portion is a container base and said second container portion is a container cover.

3. The display package of claim 1, further comprising an insert card located within said first container portion and secured between a base portion of said first container portion and said front blister surface.

4. The display package of claim 1, wherein said storage container includes a latch mechanism displaceable between locked and unlocked positions and configured to secure said first and second container portions to one another when said second container portion is in the closed position and said latch mechanism is in the locked position, said latch mechanism fixed in the unlocked position by said blister assembly when said first container portion is secured in said first cavity of said blister assembly.

5. The display package of claim 1, wherein said storage container includes an elastomeric member fixed to said outer surface of said second container portion and surrounding said magnet.

6. The display package of claim 1, further comprising an aperture extending through at least one of said container cover and said container base.

7. A method comprising:

providing a display package including a storage container secured to a blister assembly, said storage container including:

a container base;

a container cover hingedly coupled to said container base and displaceable between open and closed positions while said storage container is secured to said blister assembly; and a magnet fixed to an outer surface of said container cover and extending laterally to or beyond an outer perimeter defined by a lateral edge of said front and rear blister surfaces of said blister assembly when said container cover is in the open position;

locating the container cover in the open position; and attaching said display package to a metallic structure via said magnet.

8. The method of claim 7, wherein said attaching includes said outer perimeter of said blister assembly being located adjacent said metallic structure.

9. The method of claim 7, wherein said container cover is located in the open position before said attaching.

10. The method of claim 7, further comprising displaying an insert card secured within said container base when said container cover is located in the open position.

11. The method of claim 7, wherein said storage container includes a latch mechanism displaceable between locked and unlocked positions and configured to secure said container cover to said container base when said container cover is in the closed position and said latch mechanism is in the locked position, said latch mechanism fixed in the unlocked position while said display package is attached to said metallic structure.

12. The method of claim 7, wherein said storage container includes an elastomeric member fixed to said outer surface of said container cover and surrounding said magnet, said attaching including said elastomeric member abutting said metallic structure.

13. The method of claim 7, wherein said container cover is generally perpendicular to said container base after said attaching.

14. The method of claim 7, wherein an aperture extends through at least one of said container cover and said container base.

* * * * *